US011794063B2

(12) United States Patent
Rojas

(10) Patent No.: US 11,794,063 B2
(45) Date of Patent: Oct. 24, 2023

(54) EXERCISE BENCH ADD-ON APPARATUS

(71) Applicant: Nicole Rojas, Murray, UT (US)

(72) Inventor: Nicole Rojas, Murray, UT (US)

( * ) Notice: Subject to any disclaimer, the term of this patent is extended or adjusted under 35 U.S.C. 154(b) by 0 days.

(21) Appl. No.: 17/669,488

(22) Filed: Feb. 11, 2022

(65) Prior Publication Data

US 2022/0314059 A1 Oct. 6, 2022

Related U.S. Application Data

(60) Provisional application No. 63/171,233, filed on Apr. 6, 2021.

(51) Int. Cl.

| | |
|---|---|
| ***A63B 21/078*** | (2006.01) |
| ***A63B 23/025*** | (2006.01) |
| ***A63B 23/02*** | (2006.01) |

(52) U.S. Cl.

CPC ..... *A63B 21/078* (2013.01); *A63B 23/025* (2013.01); *A63B 23/0211* (2013.01); *A63B 23/0238* (2013.01); *A63B 2209/10* (2013.01)

(58) Field of Classification Search

CPC ..... A63B 21/078; A63B 23/0211; A63B 23/0238; A63B 23/025; A63B 2209/10; A63B 21/00047; A63B 21/0726; A63B 21/4039; A63B 21/4029

See application file for complete search history.

(56) References Cited

U.S. PATENT DOCUMENTS 1,904,039 A * 4/1933 Bruder ..... A63B 23/0211 606/240
2,771,875 A * 11/1956 Cason ..... A61H 23/0263 601/26
2,785,418 A * 3/1957 Goguen ..... A61G 7/0755 5/632
3,601,121 A * 8/1971 Roberts ..... A61H 23/02 5/915
3,890,004 A * 6/1975 Rail ..... A47C 15/004 5/652
4,474,370 A * 10/1984 Oman ..... A63B 21/4029 5/657
4,621,809 A * 11/1986 Pearl ..... A63B 21/4029 482/104
5,007,414 A * 4/1991 Sexton ..... A61F 5/01 602/19

(Continued)

*Primary Examiner* — Garrett K Atkinson
(74) *Attorney, Agent, or Firm* — Brennan, Manna & Diamond, LLC

(57) ABSTRACT

The present invention relates to an exercise bench attachment that is secured to a workout bench surface via a multi-stick backing. The exercise bench attachment assists with performing chest exercises. The attachment includes shoulder grooves or openings on either sides of a spinal cord supporting portion for accommodating shoulder blades of a user lying in a supine position with the bench attachment secured between the user's neck and back, and the bench surface. The shoulder openings enable free movement of shoulder blades when performing chest exercises of moving barbells, dumbbells, or weights away and towards the chest. The device includes a neck support for providing cushion to the neck of the user. The attachment supports the back and spine, but enhances clearance and space for the shoulder blades to enable the scapula to move unrestricted.

16 Claims, 5 Drawing Sheets

(56) References Cited

U.S. PATENT DOCUMENTS 5,070,865 A * 12/1991 Iams ..... A47G 9/1009 606/240
5,348,523 A * 9/1994 Blount ..... A63B 21/078 5/652
5,447,481 A * 9/1995 Emter, Jr. ..... A63B 21/078 482/142
5,474,513 A * 12/1995 Carlesimo ..... A63B 23/0211 606/240
5,649,886 A * 7/1997 Danylieko ..... A63B 21/4029 482/142
5,820,573 A * 10/1998 Ramos ..... A61H 7/001 606/240
5,840,001 A * 11/1998 Schedel ..... A61H 1/0218 606/244
8,864,233 B2 * 10/2014 Wei ..... A47C 1/022 297/195.11
D787,072 S * 5/2017 Pryce-Jones ..... D24/183
2003/0199370 A1 * 10/2003 Bucay-Bissu ..... A63B 21/4031 482/142
2004/0220028 A1 * 11/2004 Gamble ..... A63B 21/00047 482/142
2010/0249495 A1 * 9/2010 Siradag ..... A47C 15/008 600/38
2011/0220122 A1 * 9/2011 Barad ..... B32B 38/1866 128/845
2011/0224059 A1 * 9/2011 Crawley ..... A63B 21/4029 482/142
2014/0342888 A1 * 11/2014 Cecil ..... A63B 21/4039 482/142
2015/0224359 A1 * 8/2015 Kalleen ..... A63B 71/0054 482/104
2018/0193689 A1 * 7/2018 Farris ..... A63B 21/4039
2019/0209423 A1 * 7/2019 Mercenari Uribe ..... A63B 1/00
2021/0316183 A1 * 10/2021 Rios Ocasio ..... A63B 21/4029

* cited by examiner

EXERCISE BENCH ADD-ON APPARATUS

CROSS-REFERENCE TO RELATED APPLICATION

The present application claims priority to, and the benefit of, U.S. Provisional Application No. 63/171,233, which was filed on Apr. 6, 2021 and is incorporated herein by reference in its entirety.

FIELD OF THE INVENTION

The present invention relates generally to the field of exercise aid equipment. More specifically, the present invention relates to an exercise assistance apparatus that can be placed on a back of a chair, floor, or the horizontal surface of an exercise bench via a multi-stick backing and maximizes scapular clearance and shoulder mobility to improve form and posture while sitting or weightlifting (i.e bench pressing). The apparatus can be made from foam. More specifically, the apparatus includes grooves for accommodating shoulders of the user during exercising and while lying on the apparatus in a supine position. The apparatus includes a neck support for cushioning the neck, a spinal cord supporting portion for supporting and stabilizing the spinal cord, and a downward sloping section for supporting the back of the user. The apparatus can be used as needed while sitting or exercising to help improve posture while ensuring proper scapular clearance during weightlifting movements. Accordingly, the present disclosure makes specific reference thereto. Nonetheless, it is to be appreciated that aspects of the present invention are also equally applicable to other like applications, devices, and methods of manufacture.

BACKGROUND

By way of background, standard gym benches or weight benches are versatile pieces of workout equipment that can support a wide array of workouts. Generally, a user lies supine on such a bench and pushes a barbell or fixed weight such as a dumbbell vertically upwards from the chest or laterally outwards (i.e. sidewards) from the chest to develop pectoral muscles. For exercising chest muscles, the horizontal or inclined bench is one of the most important pieces of equipment and maximum stretch is desired by people for gaining maximum effect of the exercises. However, standard gym benches are relatively wide such that the scapular of an exercising user is supported by the bench that prohibits the scapula to move and retract in a safe way. Further, such benches inhibit maximum stretch of the pectoral muscle during chest exercises, ultimately prohibiting the exercises from realizing their maximum potential. People end up doing more exercises and repetitions without achieving maximum benefits.

Also, wide benches can put unnecessary stress on the scapula which can lead to serious shoulder injuries. Rounding forward of the scapula (i.e. bad posture) when exercising on wide benches decreases shoulder mobility. People desire a method and device for exercising on standard benches that reduces stress on the scapula.

People working out in gyms and at home can sustain injuries while working on horizontal or inclined benches and therefore try to do exercises on the floor which can result in similar problems. Therefore, people desire a method and device to perform exercises on wide benches that can provide maximum benefits while prohibiting negative effects.

Therefore, there exists a long felt need in the art for an exercise aid device that can be easily used with wide exercise benches. There is also a long felt need in the art for an exercise bench attachment that enables maximum shoulder mobility while performing chest exercises. Additionally, there is a long felt need in the art for an exercise aid device that provides maximum stretch of the pectoral muscle during chest exercises. Moreover, there is a long felt need in the art for an attachment that reduces stress on the scapula. Furthermore, there is a long felt need in the art for an exercise bench attachment that can be used at both a commercial gym and a home gym. Finally, there is a long felt need in the art for an exercise bench attachment that improves overall posture while exercising, promotes proper development of muscles, and eliminates the worry of inhibiting the pectoral muscles during chest exercises.

The subject matter disclosed and claimed herein, in one embodiment thereof, comprises an exercise bench add-on device configured to be used in conjunction with an exercise bench, floor surface, or chair. The device includes a tapered foam body that helps in maximizing scapular clearance and shoulder mobility while exercising. The device includes shoulder grooves for supporting the scapula and a spine supporting portion for supporting the spine of the user. The device is positioned on a surface of the bench and the user can lie in a supine position on top of the device. The device improves overall posture while exercising, promotes proper development of the muscles in the back, and eliminates the worry of inhibiting the pectoral muscles during chest exercises.

In this manner, the exercise bench add-on device of the present invention accomplishes all of the forgoing objectives and provides users with an attachment that can be placed on the back of a chair, the floor, or the surface of an exercise bench via a multi-stick backing. A user can perform chest exercises while lying in a supine position on the device thereby enabling maximum range of movement of shoulder blades without applying additional pressure on the body. The device also enables maximum stretch of the pectoral muscles during chest exercises for maximum gains, benefits, and effects.

SUMMARY OF THE INVENTION

The following presents a simplified summary in order to provide a basic understanding of some aspects of the disclosed innovation. This summary is not an extensive overview, and it is not intended to identify key/critical elements or to delineate the scope thereof. Its sole purpose is to present some general concepts in a simplified form as a prelude to the more detailed description that is presented later.

The subject matter disclosed and claimed herein, in one embodiment thereof, comprises an exercise bench attachment. The exercise bench attachment is configured to be removably attached to an exercise bench for an exercising user to perform chest exercises with enhanced clearance for shoulder blades. The exercise bench attachment further comprising a top surface and a bottom surface, the top surface includes counters for supporting the exercising user lying in a supine position, the bottom surface includes a multi-layer adhesive back, a neck support for providing support to the neck of the exercising user, a spinal cord supporting portion extending from the neck support, the spinal cord supporting portion supports the spine of the exercising user placed thereon, the spinal cord supporting portion is elevated from the top surface of the attachment thereby forming a left shoulder supporting groove and a right shoulder supporting groove on the top surface for accommodating the left shoulder and the right shoulder of the exercising user, the grooves enable movement of the scapula in a safe way when the exercising user performs a chest exercise by moving (i.e. pushing) weights away from the chest and pulling same towards the chest.

In yet another embodiment, an exercise bench add-on device configured to be used in conjunction with an exercise bench, floor, or chair is disclosed. The device includes a tapered foam body that helps in maximizing scapular clearance and shoulder mobility while exercising. The device includes shoulder grooves for supporting the scapula and a spine supporting portion for supporting the spine of the user. The device can be positioned on a horizontal or inclined surface of the bench and the user can lie in a supine or inclined position while using the device.

In yet another embodiment, the device can be utilized while sitting or exercising to help improve posture while ensuring proper scapular clearance is maintained.

In yet another embodiment of the present invention, an exercise aid device for performing effective chest exercises on an exercise bench is disclosed. The device is configured to firmly secure to a workout bench via a multi-stick backing that enables the device to remain in place during an exercise. The device is generally rectangular including a front surface, a rear surface, and a pair of side surfaces. The device further includes a raised neck support along the rear surface, a spinal cord supporting portion extending from the neck portion, a pair of back supporting sections, a left shoulder supporting groove formed between the spinal cord supporting portion and the left side surface and a right shoulder supporting groove formed between the spinal cord supporting portion and the right side surface, and a downward sloping portion from the back supporting sections to the front surface.

In yet another embodiment, the right shoulder supporting groove accommodates a right shoulder of the user working out in a supine position and the left shoulder supporting groove accommodates a left shoulder of the user working out in the supine position.

In yet still another embodiment, the attachment or exercise aid device can be made from soft foam that remains dense enough to maintain support.

To the accomplishment of the foregoing and related ends, certain illustrative aspects of the disclosed innovation are described herein in connection with the following description and the annexed drawings. These aspects are indicative, however, of but a few of the various ways in which the principles disclosed herein can be employed and are intended to include all such aspects and their equivalents. Other advantages and novel features will become apparent from the following detailed description when considered in conjunction with the drawings.

BRIEF DESCRIPTION OF THE DRAWINGS

The description refers to provided drawings in which similar reference characters refer to similar parts throughout the different views, and in which.

DETAILED DESCRIPTION OF THE PRESENT INVENTION

Figure 1:
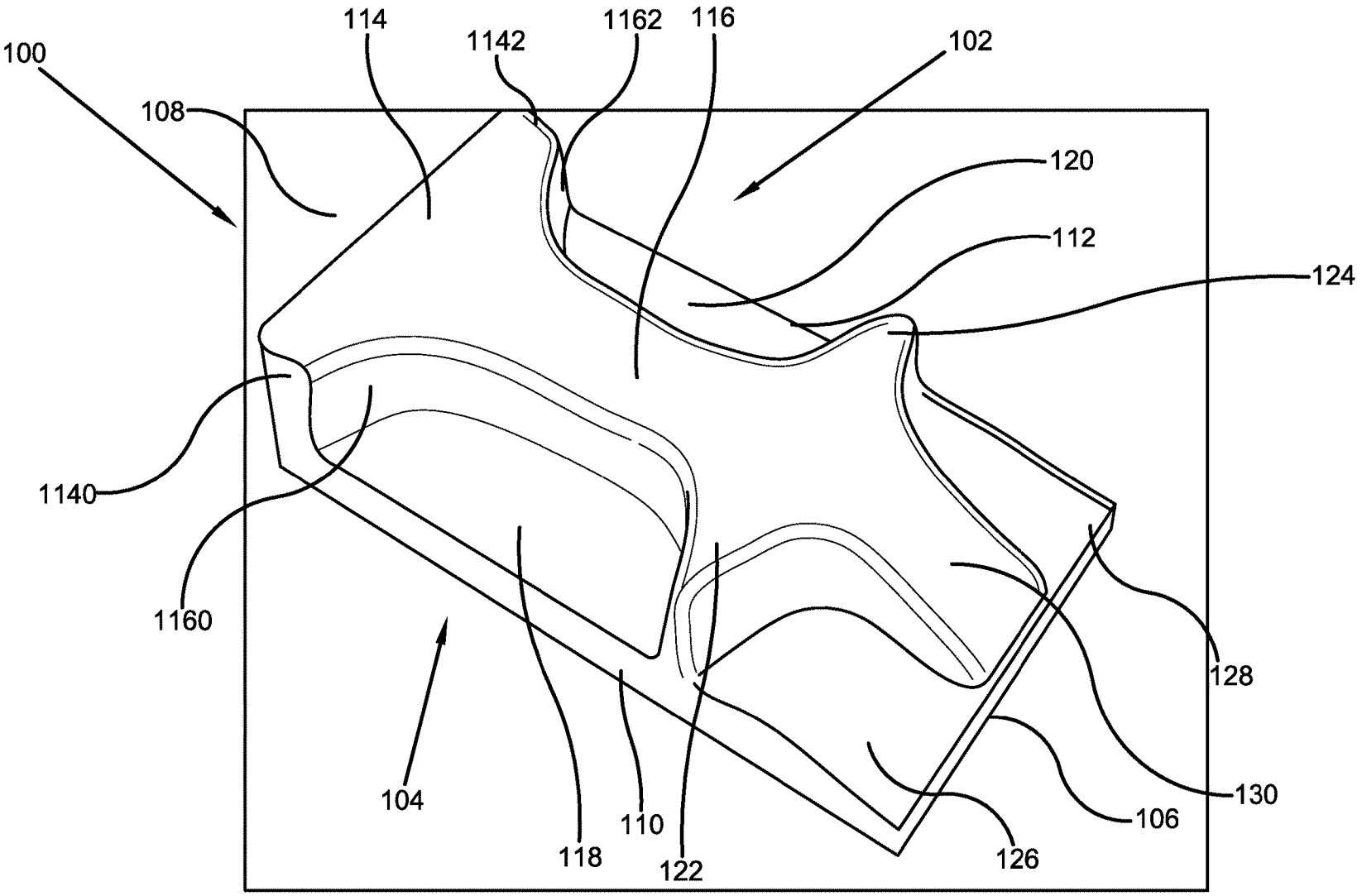
FIG. 1 illustrates a perspective view of one potential embodiment of an exercise foam attachment of the present invention in accordance with the disclosed architecture.

The innovation is now described with reference to the drawings, wherein like reference numerals are used to refer to like elements throughout. In the following description, for purposes of explanation, numerous specific details are set forth in order to provide a thorough understanding thereof. It can be evident, however, that the innovation can be practiced without these specific details. In other instances, well-known structures and devices are shown in block diagram form in order to facilitate a description thereof. Various embodiments are discussed hereinafter. It should be noted that the figures are described only to facilitate the description of the embodiments. They are not intended as an exhaustive description of the invention and do not limit the scope of the invention. Additionally, an illustrated embodiment need not have all the aspects or advantages shown. Thus, in other embodiments, any of the features described herein from different embodiments can be combined.

As noted above, there exists a long felt need in the art for an exercise aid device that can be easily used with wide exercise benches. There is also a long felt need in the art for an exercise bench attachment that enables maximum shoulder mobility while performing chest exercises. Additionally, there is a long felt need in the art for an exercise aid device that provides maximum stretch of the pectoral muscle during chest exercises. Moreover, there is a long felt need in the art for an attachment that reduces stress on the scapula. Furthermore, there is a long felt need in the art for an exercise bench attachment that can be used at both a commercial gym and a home gym. Finally, there is a long felt need in the art for an exercise bench attachment that improves overall posture while exercising, promotes proper development of muscles, and eliminates the worry of inhibiting the pectoral muscles during chest exercises.

The present invention, in one exemplary embodiment, is a novel exercise aid device for performing effective chest exercises on an exercise bench. The device is configured to firmly secure to a workout bench via a multi-stick backing that enables the device to remain in place during an exercise. The device is generally rectangular including a front surface, a rear surface, and a pair of side surfaces. The device further includes a raised neck support along the rear surface, a spinal cord supporting portion extending from the neck portion, a pair of back supporting sections, a left shoulder supporting groove formed between the spinal cord supporting portion and the left side surface and a right shoulder supporting groove formed between the spinal cord supporting portion and the right side surface, and a downward sloping portion from the back supporting sections to the front surface.

Referring initially to the drawings, FIG. 1 illustrates a perspective view of one potential embodiment of exercise foam attachment 100 of the present invention in accordance with the disclosed architecture. The exercise foam attachment 100 is designed to be used as an ergonomic attachment in conjunction with an exercise bench, on the floor, or while sitting in a chair. The attachment 100 firmly secures to a workout bench enabling a user to use the attachment 100 for any type of exercise. More specifically, the attachment 100 improves overall posture while exercising and promotes proper development of muscles in and around the shoulders, chest, and back while eliminating the worry of inhibiting range of motion of the pectoral muscles during chest exercises. The attachment 100 includes a rectangular top surface 102 and a bottom surface 104. The bottom surface 104 includes adhesive backing as best shown in FIG. 2A. Further, the bottom surface 104 is planar and can be placed on a flat (horizontal or inclined) exercise bench, floor, or in a chair. The attachment 100 is made of a soft material such as foam and includes a mounded or pillowed top surface 102 in an elevated manner forming a front surface 106, a rear surface 108, and a pair of side surfaces 110,112.

Figure 4:
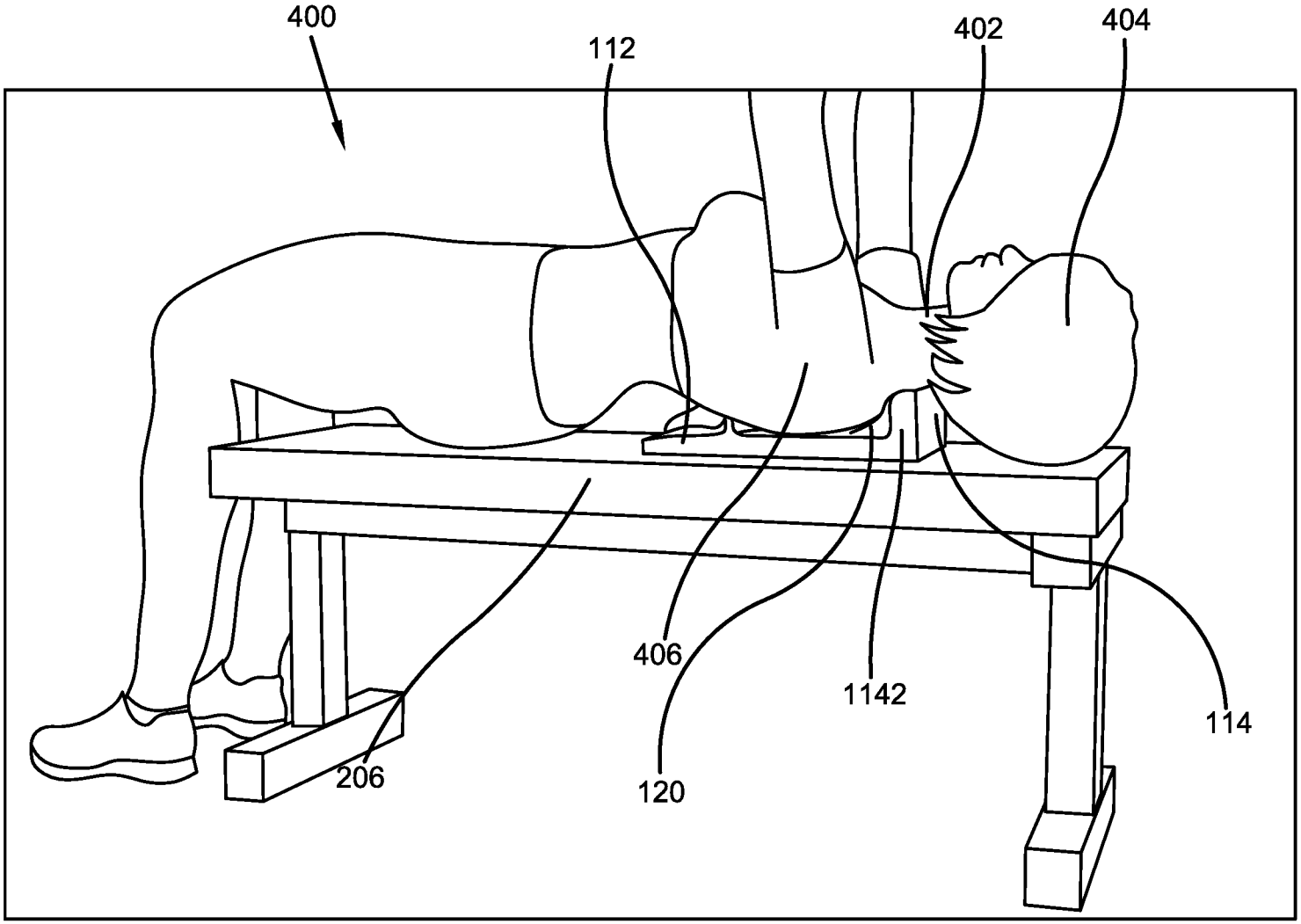
FIG. 4 illustrates a side perspective view of a user lying in a supine position on the exercise bench attachment of the present invention in accordance with the disclosed architecture.

The attachment 100 includes foam protrusions raised from the top surface 102 thereby providing support for body parts of a user using the attachment 100 during an exercise. The foam protrusion also forms grooves or cut-outs on the top surface 100 for receiving certain body parts such as a scapula of a user as described later in the disclosure. In use, the attachment 100 is positioned such that the front surface 106 lies below the spine/back portion of a user and the rear surface 108 lies below the neck portion of the user to support the neck of the user as best shown in FIG. 4.

The attachment 100 includes a raised neck support 114 along the rear surface 108. The neck support 114 is elevated from the top surface 102 and provides adequate support to the neck of the user while the user lies down on the attachment 100. The neck support 114 provides cushioning to the neck and, while the device 100 is in use, the head of the user can rest on the exercise bench or floor on which the attachment 100 is positioned. The neck portion 114 is defined by the rear surface 108, vertical side walls 1140, 1142, and the arcuate protrusions 1160,1162.

A spinal cord supporting portion 116 extends from the neck portion 114 to the back supporting sections 122,124. The spinal cord supporting portion 116 is raised relative to the top surface 102 and includes a slight concave curvature for maintaining neutral cervical curvature and alignment for the user's bodily comfort. The spinal cord supporting portion 116 is longitudinal and is around 70% of the total length of the attachment 100 measured from the front surface 106 to the rear surface 108. The spinal cord supporting portion 116 supports the spinal cord of the user during exercise and provides stability during same.

Figure 5:
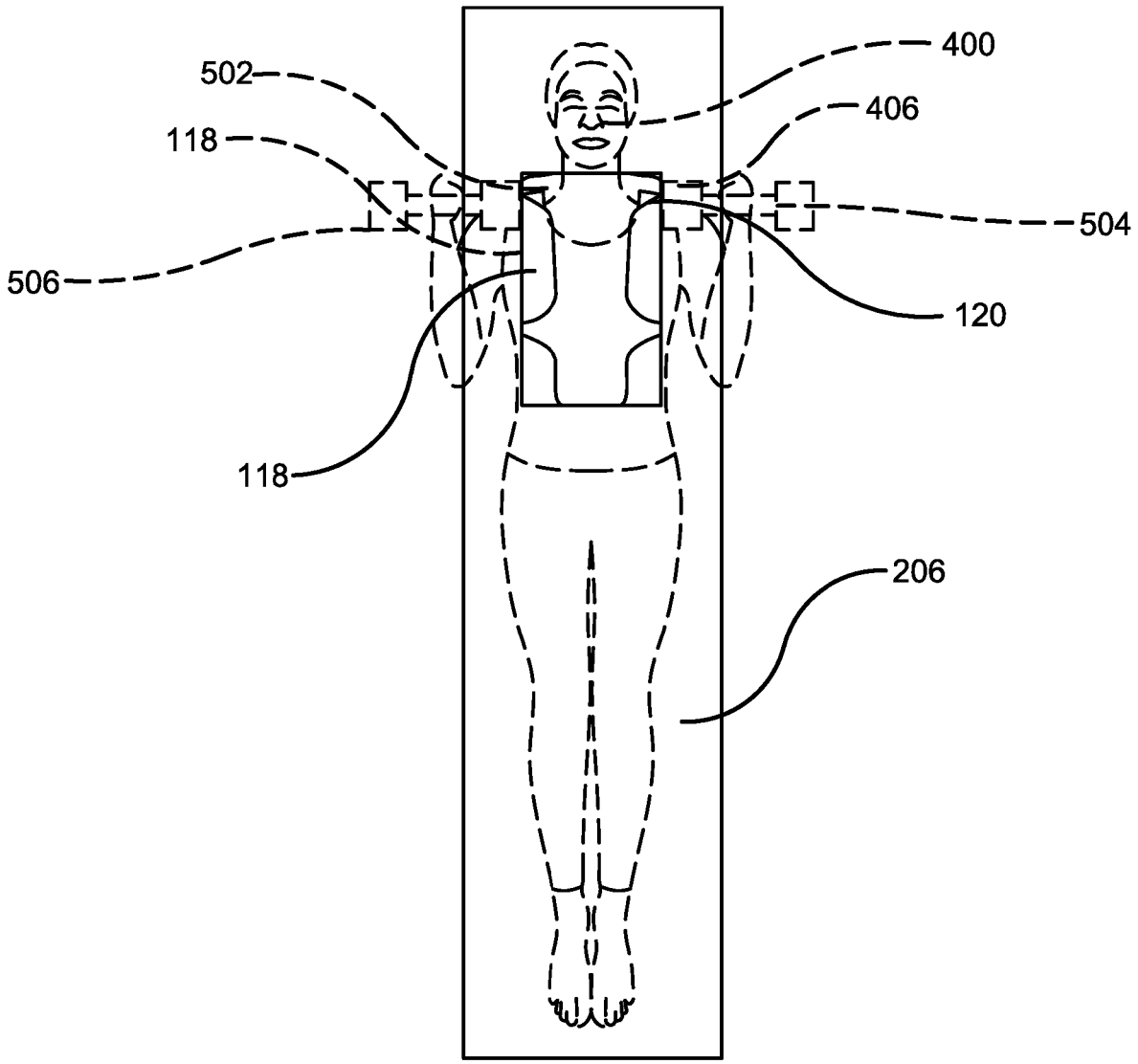
FIG. 5 illustrates a top perspective view of the user lying in a supine position on the attachment of the present invention when the attachment is secured to a surface of the exercise equipment in accordance with the disclosed architecture.

The spinal cord supporting portion 116 being raised in configuration relative to the top surface 102, forms a right shoulder supporting groove 118 between the spinal cord supporting portion 116 and the right-side surface 110 of the attachment 100. Similarly, a left shoulder supporting groove 120 is formed between the spinal cord supporting portion 116 and the left side surface 112 of the attachment 100. The right shoulder supporting groove 118 is designed to receive the right shoulder of a user as best shown in FIG. 5 and provides maximum scapular clearance while doing an exercise such as a barbell bench press, a dumbbell bench press, an incline bench press, a decline bench press, a chest fly, or more. The left shoulder supporting groove 120 is designed to receive the shoulder of the user as best shown in FIGS. 4 and 5 and provides maximize scapular clearance while doing the exercise such as the barbell bench press, the dumbbell bench press, the incline bench press, the decline bench press, the chest fly, or more. The shoulder supporting cutouts 118,120 are countered to accommodate and support the shoulders of the exercising user and to provide desired shoulder mobility and range of motion.

It should be understood that a size of the shoulder grooves 118,120 can be chosen to accommodate different shoulder sizes (e.g., the size of the shoulder cutouts 118,120 can conform to a small, medium, and large sizing scale). The spinal cord supporting portion 116 along with the neck support 114 supports the back and spine but enhances clearance where the shoulder blades hit to enable the scapula to move without applying additional pressure on the body of the exercising user.

The attachment 100 includes the back supporting sections 122,124 extending laterally on opposite sides from where the spinal cord supporting portion 116 ends. The back supporting section 122,124 are positioned under the upper back of the exercising user and provides support across the back. It should be noted that the back supporting sections 122,124 are slightly raised in comparison to the concave curvature of the spinal cord supporting portion 116.

From the back supporting sections 122,124, a downward sloping front support 130 extends to the front surface 106. The downward sloping front support 130 is designed to avoid extending pressure on the lower spinal cord and back of the exercising user. The downward sloping front support 130 forms two grooves 126,128 on both sides of the downward sloping front support 130 for creating a gap between the attachment 100 and the lower spinal cord and back of the exercising user. The grooves 126,128 are slightly downward sloped thus making the top surface 102 slightly sloped near the front surface 106. The downward sloping front support 130 provides a wedge like foam structure to the attachment 100 that also improves range of mobility of the body of the exercising user.

The height of the top surface 102 is in the range of about 1 inch to about 4 inches. The height of the vertical walls 1140,1142 is in the range of about 3 inches to about 4 inches wherein the vertical walls 1140,1142 extend from rear surface 108. The length of the spinal cord supporting portion 116 is in the range of about 8 inches to about 16 inches, for example, and the downward sloping front support 130 is preferably at about sixty degrees relative to the back supporting sections 122,124.

Figure 2B:
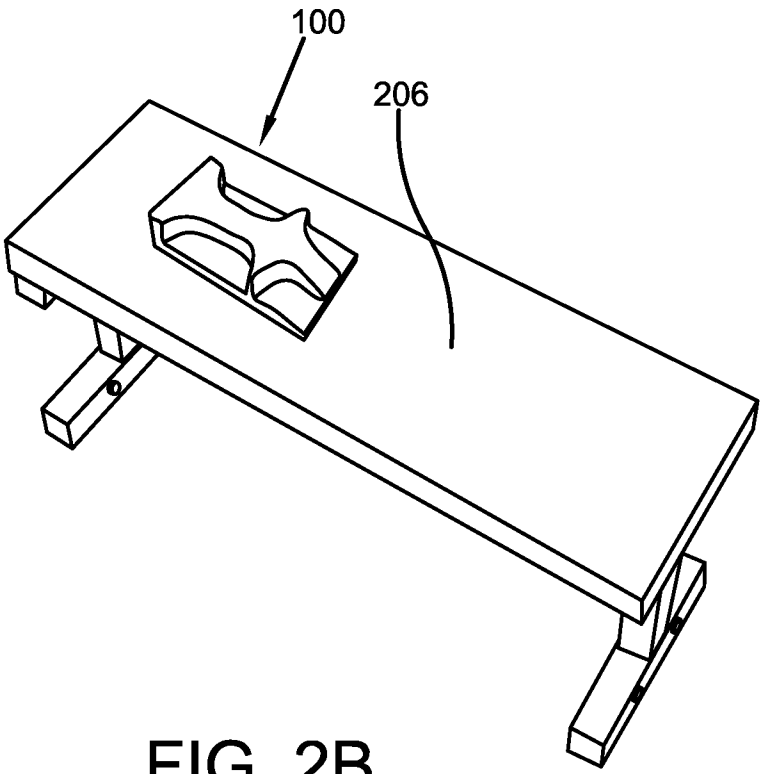
FIG. 2B illustrates a perspective view of the tapered foam exercise aid device of the present invention placed on a conventional exercise bench for use in accordance with the disclosed architecture
Figure 2A:
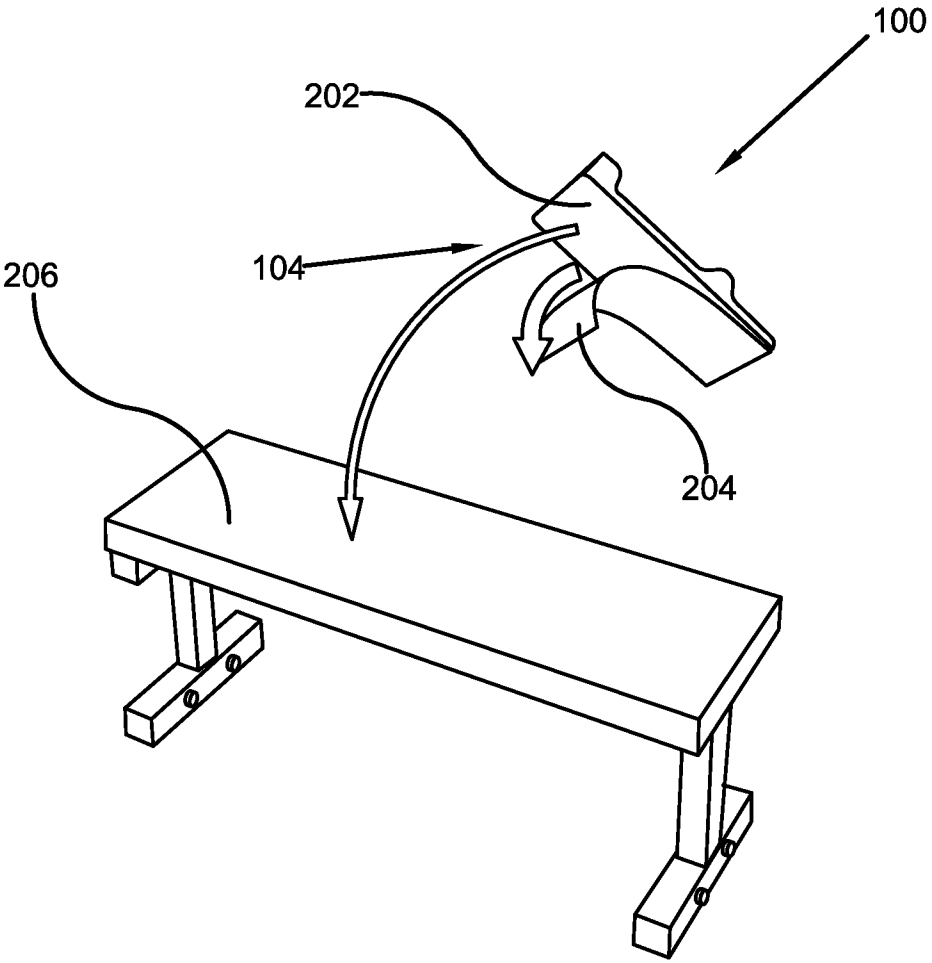
FIG. 2A illustrates a perspective view of how the tapered foam exercise aid device of the present invention may be placed on a conventional exercise bench for use in accordance with the disclosed architecture.

FIGS. 2A and 2B illustrate a perspective view showing how the tapered foam exercise aid device 100 of the present invention is placed on a conventional horizontal exercise bench for use in accordance with the disclosed architecture. As shown in FIG. 2A, the bottom surface 104 of the attachment 100 includes an adhesive backing 202 that is exposed by removing a protective sheet 204 for attaching the attachment 100 on a planar surface such as horizontal exercise bench surface 206. It should be understood that the adhesive backing 202 is a multilayer backing and is reusable. Further, the backing 202 does not cause any harm or damage to the surface 206 or any other surface on which the attachment 100 is placed. When not required, the attachment 100 can be removed from the surface.

As shown in FIG. 2B, the exercise aid device 100 is placed on the exercise bench surface 206 on the bottom surface 104. The adhesive backing 202 as shown in FIG. 2A adheres to the surface 206, thereby enabling a user to perform bench exercises where the attachment 100 supports the back and spine without the worry of inhibiting the pectoral muscles during chest exercises.

Figure 3:
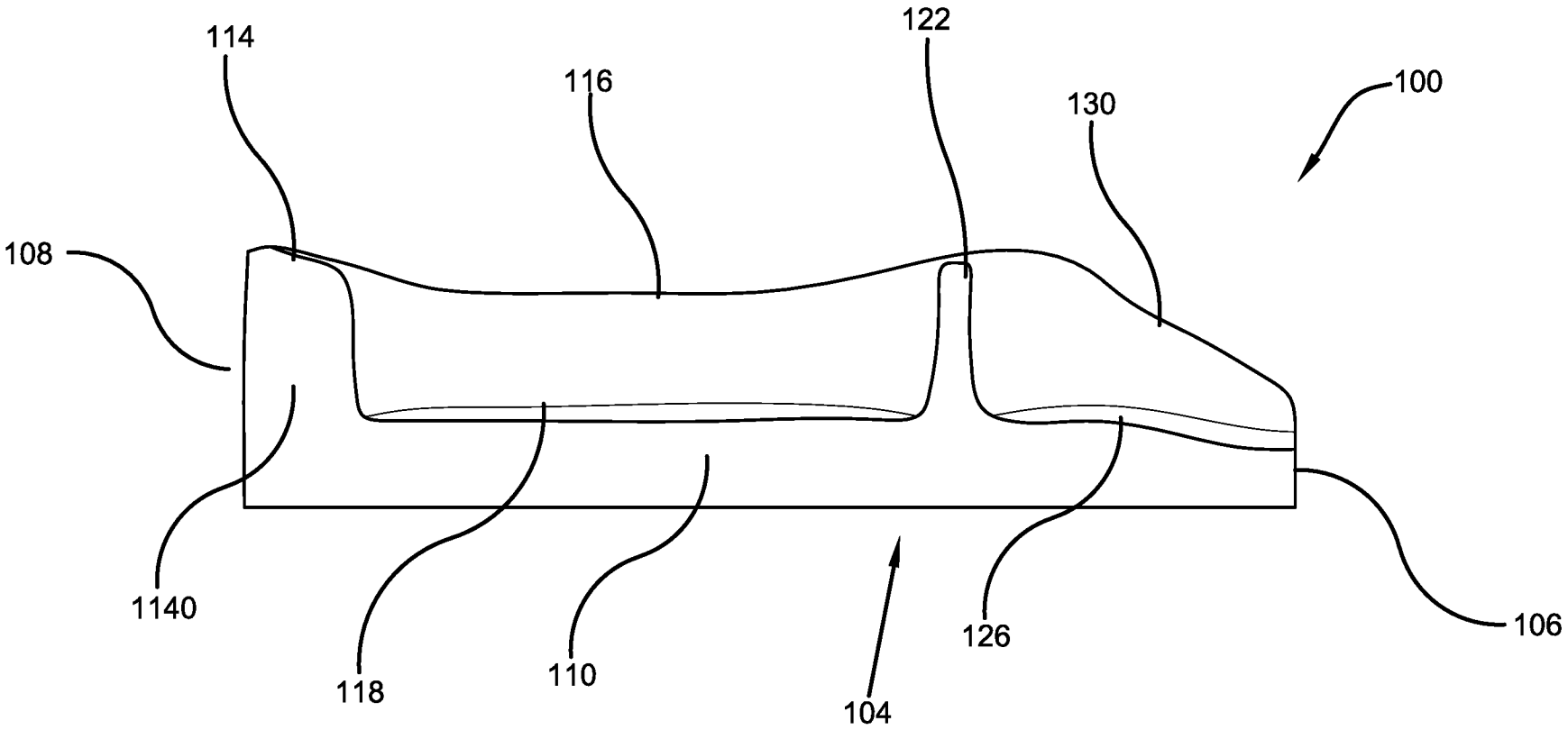
FIG. 3 illustrates a right side perspective view of the exercise aid device of the present invention in accordance with the disclosed architecture.

FIG. 3 illustrates a right side perspective view of the exercise aid device 100 of the present invention in accordance with the disclosed architecture. The right-side perspective view shows the concave curvature of the spinal cord supporting portion 116 that is designed to provide support to an exercising user lying in a supine position. The neck support 114 and the back support 122 are slightly raised relative to the spinal cord supporting portion 116 and thus support the neck and back of the user without any bodily exertion. The bottom surface 104 is planar and provides adhesion to any surface on which the device 100 is placed.

The device 100 preferably includes a length in the range of about 12 inches to about 24 inches from the rear surface 108 to the front surface 106. The right shoulder supporting groove 118 is circumscribed by the neck support 114, spinal cord supporting portion 116, and the back supporting portion 122. It is also shown that the groove 126 is also slightly downward sloping from the back support 122 to the front surface 106.

FIG. 4 illustrates a side perspective view of a user 400 lying in a supine position on the exercise bench attachment 100 of the present invention in accordance with the disclosed architecture. The attachment 100 includes a foam-based structure designed to maximize scapular clearance and shoulder mobility (i.e. range of motion) while exercising. As the user 400 lies on the attachment 100, the attachment is affixed to the surface 206 of the bench. The neck 402 of the user 400 rests on the neck support 114 and the spine (not shown) of the user 400 rests on the spinal cord supporting portion 116 as described supra. As shown, the left shoulder 406 of the user 400 is accommodated in the left shoulder supporting groove 120 thereby resting the shoulder 406 at a lower level than the spinal cord and neck of the user 400 which enables a scapula to move and retract in a safe way. The shoulder 406 freely moves while the user 400 performs any chest exercise and also enables maximum stretch of the pectoral muscles.

It should be appreciated that the head 404 of the user 400 rests on the bench surface 206 while the shoulders and neck 402 rests on the device 100 thereby providing stability and support to the user 400.

FIG. 5 illustrates a top perspective view of the user 400 lying in a supine position on the attachment 100 of the present invention when the attachment 100 is secured to surface of the exercise equipment in accordance with the disclosed architecture. As shown, the user 400 lies on the attachment 100 which is secured to exercise bench surface 206 such that the left shoulder blade 406 is positioned in the left shoulder groove 120 and the right shoulder blade 502 is positioned in the right shoulder groove 118 of the attachment 100. This enables the user 400 to move the shoulder blades 406,502 when performing the chest exercise using the dumbbells 504,506. Due to free movement of the shoulder blades, the pectoral muscles of the user 400 are stretched to the maximum limit which increases efficiency of the exercise.

Certain terms are used throughout the following description and claims to refer to particular features or components. As one skilled in the art will appreciate, different persons can refer to the same feature or component by different names. This document does not intend to distinguish between components or features that differ in name but not structure or function. As used herein "exercise foam attachment", "exercise aid device", "exercise bench add-on device", "exercise bench attachment", "device", and "attachment" are interchangeable and refer to the exercise bench add-on device 100 of the present invention.

Notwithstanding the forgoing, the exercise bench add-on device 100 of the present invention can be of any suitable size and configuration as is known in the art without affecting the overall concept of the invention, provided that it accomplishes the above stated objectives. One of ordinary skill in the art will appreciate that the size, configuration, and material of the exercise bench add-on device 100 as shown in the FIGS. are for illustrative purposes only, and that many other sizes and shapes of the exercise bench add-on device 100 are well within the scope of the present disclosure. Although the dimensions of the exercise bench add-on device 100 are important design parameters for user convenience, the exercise bench add-on device 100 can be of any size that ensures optimal performance during use and/or that suits the user's needs and/or preferences.

Various modifications and additions can be made to the exemplary embodiments discussed without departing from the scope of the present invention. While the embodiments described above refer to particular features, the scope of this invention also includes embodiments including different combinations of features and embodiments that do not include all of the described features. Accordingly, the scope of the present invention is intended to embrace all such alternatives, modifications, and variations as fall within the scope of the claims, together with all equivalents thereof.

What has been described above includes examples of the claimed subject matter. It is, of course, not possible to describe every conceivable combination of components or methodologies for purposes of describing the claimed subject matter, but one of ordinary skill in the art can recognize that many further combinations and permutations of the claimed subject matter are possible. Accordingly, the claimed subject matter is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. An exercise attachment for improving overall posture and range of motion while bench pressing, the exercise attachment comprising:

an elevated top surface having a neck supporting portion, a spinal cord supporting portion comprising a curvature configured to maintain a neutral spine curvature, a right side back supporting portion, a left side back supporting portion and a downward sloping front support portion, wherein said neck supporting portion supports a user's neck while lying in a supine position;

a planar bottom surface;

a front surface;

a rear surface;

a right side surface;

a left side surface;

a right shoulder groove formed between said neck supporting portion, said spinal cord supporting portion and said right side back supporting portion, wherein said right shoulder groove accommodates a user's right shoulder blade for a range of motion while in the supine position and bench pressing; and a left shoulder groove formed between said neck supporting portion, said spinal cord supporting portion and said left side back supporting portion, wherein said left shoulder groove accommodates a user's left shoulder blade for a range of motion while in the supine position and bench pressing; and wherein the planar bottom surface comprises a multilayer reusable adhesive backing for securing to a surface of an exercise bench and a removable protective sheet disposed over the multilayer reusable adhesive backing.

2. The exercise attachment of claim 1, wherein said elevated top surface is elevated from said bottom surface in the range of about 1 inch to about 4 inches.

3. The exercise attachment of claim 2, wherein said elevated top surface is concave.

4. The exercise attachment of claim 1, wherein said spinal cord supporting portion includes a length in the range of about 8 inches to about 16 inches.

5. The exercise attachment of claim 4, wherein said exercise attachment includes a length in the range of about 12 inches to about 24 inches.

6. The exercise attachment of claim 5, wherein said length of said spinal cord supporting portion is about 70% of said length of said exercise attachment.

7. The exercise attachment of claim 1, wherein said downward sloping front support portion slopes generally downward at an angle of about 60 degrees relative to said right side and left side back supporting portions.

8. The exercise attachment of claim 1, wherein said exercise attachment is comprised of a soft and dense material.

9. An exercise attachment for improving overall posture and range of motion while bench pressing, the exercise attachment comprising:

a top surface having a neck supporting portion, a spinal cord supporting portion comprising a curvature configured to maintain a neutral spine curvature, a right side back supporting portion, a left side back supporting portion, and a downward sloping front support portion, wherein said neck supporting portion supports a user's neck while lying in a supine position;

a planar bottom surface;

a front surface;

a rear surface;

a right side surface;

a left side surface;

a right shoulder groove formed between said neck portion, said spinal cord supporting portion and said right side back supporting portion, wherein said right shoulder groove accommodates the user's right shoulder blade for a range of motion while lying in the supine position and bench pressing; and a left shoulder groove formed between said neck supporting portion, said spinal cord supporting portion and said left side back supporting portion, wherein said left shoulder groove accommodates a user's left shoulder blade for a range of motion while lying in the supine position and bench pressing, wherein said top surface is elevated from said planar bottom surface in the range of about 1 inch to about 4 inches, and further wherein said spinal cord supporting portion includes a length in the range of about 8 inches to about 16 inches; and wherein the planar bottom surface comprises a multilayer reusable adhesive backing for securing to a surface of an exercise bench and a removable protective sheet disposed over the multilayer reusable adhesive backing; and wherein the neck supporting portion comprises a pair of vertical sidewalls extending from the rear surface of the exercise attachment and transitioning into a pair of arcuate protrusions at a transition between the neck supporting portion and the spinal cord supporting portion.

10. The exercise attachment of claim 9, wherein said downward sloping front support portion slopes generally downward at an angle of about 60 degrees relative to said right side and left side back supporting portions.

11. The exercise attachment of claim 9, wherein said exercise attachment includes a length in the range of about 12 inches to about 24 inches.

12. The exercise attachment of claim 11, wherein said length of said spinal cord supporting portion is about 70% of said length of said exercise attachment.

13. The exercise attachment of claim 9, wherein said exercise attachment is comprised of a soft and dense material.

14. The exercise attachment of claim 9, wherein said top surface is concave.

15. An exercise attachment for improving overall posture and range of motion while bench pressing, the exercise attachment comprising:

an elevated top surface having a neck supporting portion, a spinal cord supporting portion comprising a curvature configured to maintain a neutral spine curvature, a right side back supporting portion, a left side back supporting portion, and a downward sloping front support portion comprising a pair of laterally disposed grooves sloped generally downward at an angle of approximately 60 degrees relative to said right side and left side back supporting portions, wherein said neck supporting portion supports a user's neck while lying in a supine position;

a planar bottom surface;

a front surface;

a rear surface;

a right side surface;

a left side surface;

a right shoulder groove formed between said neck supporting portion, said spinal cord supporting portion and said right side back supporting portion, wherein said right shoulder groove accommodates a user's right shoulder blade for a range of motion while lying in the supine position and bench pressing; and a left shoulder groove formed between said neck supporting portion, said spinal cord supporting portion and said left side back supporting portion, wherein said left shoulder groove accommodates a user's left shoulder blade for a range of motion while lying in the supine position and bench pressing, wherein said neck supporting portion includes a pair of vertical side walls, wherein said pair of vertical side walls include a height in the range of about 3 inches to about 4 inches, and further wherein said elevated top surface is elevated from said planar bottom surface in the range of about 1 inch to about 4 inches; and wherein the neck supporting portion comprises a pair of vertical sidewalls extending from the rear surface of the exercise attachment and transitioning into a pair of arcuate protrusions at a transition between the neck supporting portion and the spinal cord supporting portion.

16. The exercise attachment of claim 15, wherein said spinal cord supporting portion includes a length in the range from about 8 inches to about 16 inches, and further wherein said exercise attachment includes a length in the range from about 12 inches to about 24 inches.

* * * * *